US011487213B2

(12) United States Patent
Katsumata

(10) Patent No.: US 11,487,213 B2
(45) Date of Patent: Nov. 1, 2022

(54) IMAGE FORMING APPARATUS

(71) Applicant: CANON KABUSHIKI KAISHA, Tokyo (JP)

(72) Inventor: Go Katsumata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/502,361

(22) Filed: Oct. 15, 2021

(65) Prior Publication Data

US 2022/0121135 A1 Apr. 21, 2022

(30) Foreign Application Priority Data

Oct. 19, 2020 (JP) ..... JP2020-175357

(51) Int. Cl.
*G03G 15/02* (2006.01)
*G03G 21/18* (2006.01)

(52) U.S. Cl.
CPC ..... *G03G 15/0225* (2013.01); *G03G 15/0216* (2013.01); *G03G 15/0233* (2013.01); *G03G 21/1814* (2013.01); *G03G 21/1821* (2013.01); *G03G 2221/1693* (2013.01); *G03G 2221/183* (2013.01)

(58) Field of Classification Search
CPC ..... G03G 15/0225; G03G 15/0216; G03G 15/0233; G03G 21/1814; G03G 21/1821; G03G 2221/1693; G03G 2221/183
See application file for complete search history.

(56) References Cited

U.S. PATENT DOCUMENTS

| | | | | |
|---|---|---|---|---|
| 6,385,420 | B1 * | 5/2002 | Morioka | G03G 21/1814 399/176 |
| 9,632,473 | B2 | 4/2017 | Kobayashi et al. | |
| 2013/0121725 | A1 * | 5/2013 | Shirayanagi | G03G 21/1814 399/111 |
| 2016/0216688 | A1 * | 7/2016 | Katayama | G03G 21/1814 |
| 2016/0252878 | A1 * | 9/2016 | Kimura | G03G 15/0216 399/176 |
| 2020/0096891 | A1 * | 3/2020 | Yamamoto | G03G 15/0216 |
| 2020/0341402 | A1 * | 10/2020 | Kitan | G03G 15/0216 |
| 2022/0163903 | A1 * | 5/2022 | Katsumata | G03G 15/0225 |

FOREIGN PATENT DOCUMENTS

| | | | |
|---|---|---|---|
| JP | 08-202241 | A | 8/1996 |
| JP | 11-095532 | A | 4/1999 |
| JP | 2001-013762 | A | 1/2001 |
| JP | 2002-311690 | A | 10/2002 |
| JP | 2016-161793 | A | 9/2016 |

* cited by examiner

*Primary Examiner* — Ryan D Walsh
(74) *Attorney, Agent, or Firm* — Venable LLP

(57) ABSTRACT

An image forming apparatus comprises a spacing member provided on a rotation shaft of a charging roller, the spacing member configured to include an engaging portion that engages with a rotation member, and to be rotatable between a spaced position at which a spaced state in which a photosensitive drum and the charging roller are spaced apart is maintained, and a released position at which the spaced state is released and the photosensitive drum and the charging roller are caused to be in contact; and a cover portion provided on the rotation shaft of the charging roller, and configured to cover an end face of the spacing member so that a fitting portion of the charging roller and the spacing member is covered.

14 Claims, 11 Drawing Sheets

IMAGE FORMING APPARATUS

BACKGROUND OF THE INVENTION

Field of the Invention

The present invention relates to an image forming apparatus including a photosensitive unit that can be mounted to an image forming apparatus using an electrophotographic process.

Description of the Related Art

Although maintenance needs to be performed at certain intervals for electrophotographic image forming apparatuses, electrophotographic image forming apparatuses that employ a method of replacing a photosensitive unit in which a photosensitive body and other parts that are related to image formation are integrated in order to facilitate the maintenance are known. Also, in image forming apparatuses that employ such a method, a contact charging method in which a charging roller that has an elastic layer is brought in contact with a photosensitive body by an urging force of a spring or the like to charge the photosensitive body is often employed.

Here, in the contact charging method, there were cases where if the photosensitive unit were left in a state in which the charging roller and the photosensitive body are in contact with each other for a long period of time, a portion of the charging roller that is in contact with the photosensitive body would become deformed, and when image formation is performed, an image defect would occur.

In order to reduce such image defect, a configuration in which a photosensitive unit is shipped in a state in which a spacer is sandwiched between a photosensitive body and a charging roller so that the photosensitive body and the charging roller do not come in contact with each other, and after the spacer is removed, the photosensitive unit is mounted to the main body of an image forming apparatus is known. However, in such a configuration, there was a problem of it being cumbersome for the user to remove the spacer when mounting a photosensitive unit to the main body of an image forming apparatus.

Therefore, Japanese Patent Laid-Open No. H 11-95532 discloses a configuration in which a photosensitive body and a charging roller are spaced apart without using a removable spacer, and when the photosensitive unit is mounted to the main body of an image forming apparatus, the charging roller that was spaced apart comes in contact with the photosensitive body by the photosensitive body rotating. Specifically, a fan-shaped engaging portion that is provided at a distal end of a spacing member which is fitted onto the rotation shaft of the charging roller is configured to space apart the photosensitive body from the charging roller in a state in which the engaging portion is engaged with the gear of the photosensitive body provided on the same axis as the photosensitive body. Then, by rotating the photosensitive body, the spacing member rotates to disengage the engagement between the gear of the photosensitive body and the spacing member, and thereby the photosensitive body and the charging roller come in contact with each other. Therefore, the spaced state of the photosensitive body and the charging roller is automatically released without the user performing a cumbersome operation such as removal of the spacer. Japanese Patent Laid-Open No. H 11-95532 also discloses a configuration in which the contact between the photosensitive body and the charging roller is withdrawn at a desired timing.

Japanese Patent Laid-Open No. 2002-311690 discloses a configuration in which a spacing member that causes contact and retreat between a photosensitive body and a charging roller is provided. The spacing member is disposed in parallel with the pressing direction of the charging roller, and the charging roller is pressed in a direction opposite to the pressing direction when the photosensitive body stops rotating such as during non-image formation. Therefore, the charging roller is in a spaced state from the photosensitive body.

When the photosensitive body is rotationally driven in a normal rotation direction at the time of image formation or the like, the spacing member rotates about the axis of the charging roller in the direction in which it is dragged due to the engagement between the gear portion of the photosensitive body and the protruding portion at the tip of the spacing member. Then, the influence of the spacing member that was supporting the shaft of the charging roller is eliminated, and the charging roller is pressed into contact with the photosensitive body by a pressurization spring.

When the photosensitive body stops rotating at the time image formation is ended or the like, the photosensitive body is rotated in a direction opposite to the normal rotation direction, and the spacing member is rotated in a direction opposite to that at the time of a normal operation due to the engagement between the gear portion of the photosensitive body and the protruding portion at the tip of the spacing member. Thus, the charging roller and the photosensitive body are returned to a spaced state.

From the viewpoint of further space saving and cost reduction of image forming apparatuses, there is a demand for reduction in the diameter of a charging roller. In the contact charging method in which the charging roller is rotated by the frictional force between the photosensitive body and the charging roller, when the charging roller is reduced in diameter, the frictional force between the photosensitive body and the charging roller decreases, and thereby there is a high risk that a slip in which the charging roller stops relative to the photosensitive body may occur. When slipping of the charging roller occurs, the photosensitive body is not uniformly charged, and thereby image defect occurs. Therefore, it is necessary to reduce the rotational load of the charging roller in order to reduce the diameter of the charging roller.

However, in a configuration in which a spacing member is supported on the rotation shaft of a charging roller as in the conventional technique, the spacing member may become a rotational load torque of the charging roller. In a normal state, since the charging roller and the spacing member are fitted together, the load will not be large. However, since the fitting portion of the spacing member and the shaft of the charging roller are exposed, there is a possibility that an unwanted substance, such as splattered toner, may enter a sliding portion. When the toner enters the sliding portion of the spacing member and the charging roller, the load of the sliding portion increases, and thereby, the rotational load torque of the charging roller increases. Therefore, when the diameter of the charging roller is reduced, slippage of the charging roller may occur.

SUMMARY OF THE INVENTION

The present invention prevents the rotational load torque of a charging roller from increasing in an image forming apparatus comprising "a mechanism that can switch between each of a spaced state in which a photosensitive body and the charging roller are spaced apart from each other and a contacting state in which the photosensitive body and the charging roller are in contact with each other using a driving force that is inputted from a driving source of the image forming apparatus".

According to a first aspect of the present invention, there is provided an image forming apparatus comprising: a frame; a photosensitive drum supported so as to be rotatable with respect to the frame; a charging roller including an elastic layer, supported by the frame so as to be rotatable, and configured to contact the photosensitive drum and charge the photosensitive drum; an urging portion configured to urge the charging roller in a direction toward the photosensitive drum; a driving source configured to rotationally drive the photosensitive drum; a rotation member configured to rotate using a driving force inputted from the driving source; a spacing member provided on a rotation shaft of the charging roller and held to be rotatable on the rotation shaft of the charging roller, the spacing member configured to include an engaging portion that engages with the rotation member and receives a driving force from the rotation member, and to be rotatable between a spaced position at which, in a state in which the engaging portion is engaged with the rotation member, a spaced state in which the photosensitive drum and the charging roller are spaced apart is maintained, and a released position at which the spaced state between the photosensitive drum and the charging roller is released and the photosensitive drum and the charging roller are caused to be in contact; and a cover portion provided on the rotation shaft of the charging roller, and configured to cover an end face of the spacing member with respect to a direction of a rotation axis of the charging roller so that a fitting portion of the charging roller and the spacing member is covered, and rotate together with the charging roller.

According to a second aspect of the present invention, there is provided an image forming apparatus comprising: a frame; a photosensitive drum supported so as to be rotatable with respect to the frame; a charging roller including an elastic layer, supported by the frame so as to be rotatable, and configured to contact the photosensitive drum and charge the photosensitive drum; an urging portion configured to urge the charging roller in a direction toward the photosensitive drum; a driving source configured to rotationally drive the photosensitive drum; a rotation member configured to rotate using a driving force inputted from the driving source; a spacing member provided on a rotation shaft of the charging roller and held to be rotatable on the rotation shaft of the charging roller, the spacing member configured to include an engaging portion that engages with the rotation member and receives a driving force from the rotation member, and to be rotatable between a spaced position at which, in a state in which the engaging portion is engaged with the rotation member, a spaced state in which the photosensitive drum and the charging roller are spaced apart is maintained, and a released position at which the spaced state between the photosensitive drum and the charging roller is released and the photosensitive drum and the charging roller are caused to be in contact; a cover portion provided on the rotation shaft of the charging roller, and configured to cover an end face of the spacing member with respect to a direction of a rotation axis of the charging roller so that a fitting portion of the charging roller and the spacing member is covered, and rotate together with the charging roller; and a clutch provided between the spacing member and the cover portion with respect to an axial direction of the rotation shaft of the charging roller, and configured to switch between a state in which rotation of the charging roller is transmitted to the spacing member and a state in which rotation of the charging roller is not transmitted to the spacing member.

Further features of the present invention will become apparent from the following description of exemplary embodiments with reference to the attached drawings.

DESCRIPTION OF THE EMBODIMENTS

Figure 1:
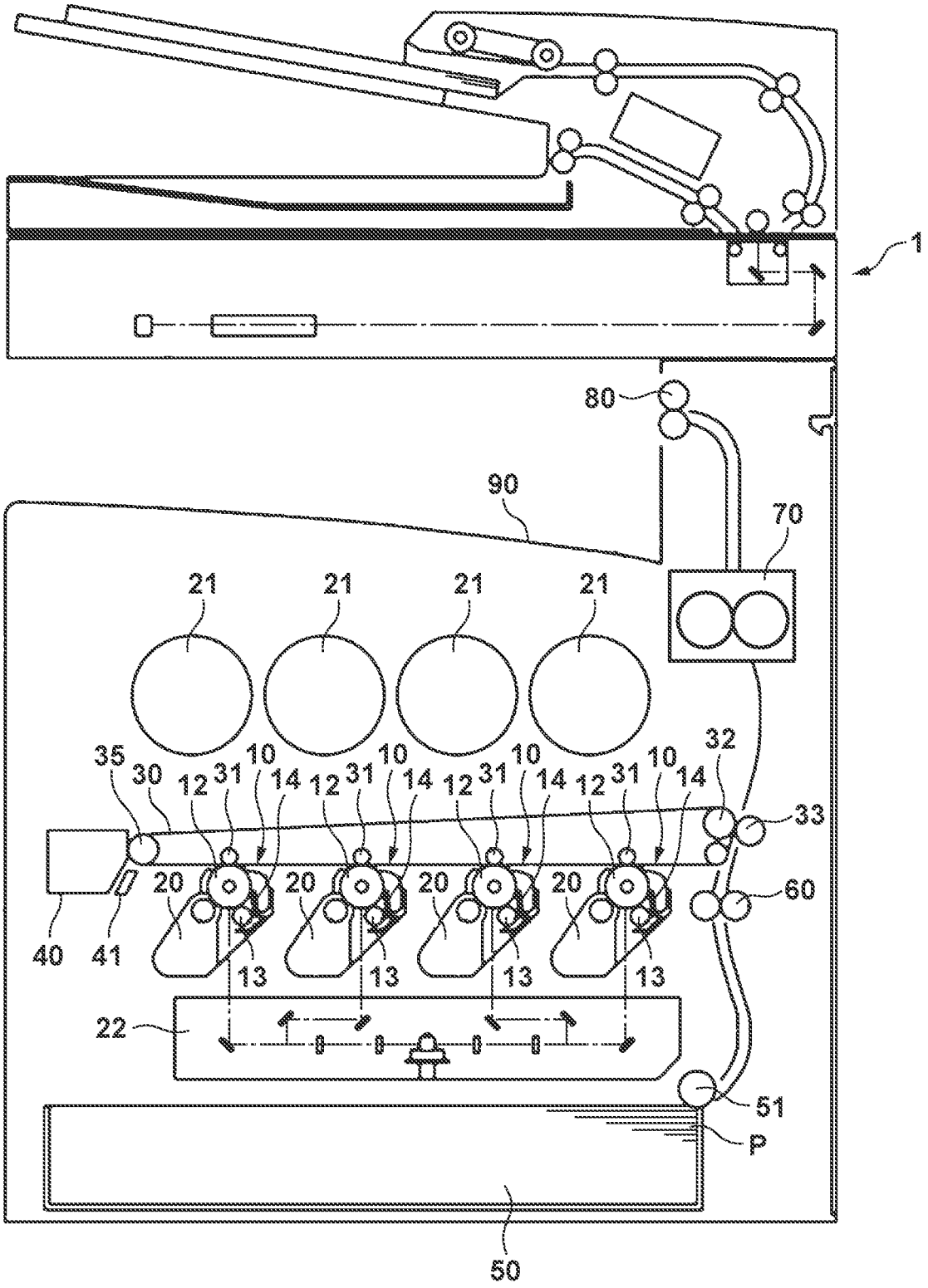
FIG. 1 is a schematic cross-sectional view of an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate.

Furthermore, in the attached drawings, the same reference numerals are given to the same or similar configurations, and redundant description thereof is omitted.

First Embodiment

First, the overall configuration and operation of an image forming apparatus will be described with reference to FIG. 1. Thereafter, a spacing mechanism for holding a charging roller and a photosensitive body apart, and an automatic releasing mechanism for releasing the holding of a space together with the driving of the photosensitive body will be described in detail.

(Overall Structure and Operation of Image Forming Apparatus)

FIG. 1 is a schematic cross-sectional view illustrating a configuration of the image forming apparatus according to a first embodiment of the present invention. An image forming apparatus 1 according to the present embodiment is a tandem image forming apparatus that employs an intermediate transfer method capable of forming a full-color image using an electrophotographic method.

The image forming apparatus 1 of the present embodiment includes four image forming units that respectively form toner images of the respective colors Y (yellow), M (magenta), C (cyan), and K (black). The configuration and operation of these four image forming units are substantially the same except that the colors of the toner used are different. Therefore, in the following description, when no particular distinction is required, Y, M, C, and K at the end of reference numbers indicating that the element is for one of the colors are omitted.

An image forming unit includes a photosensitive drum 12 (photosensitive body) as an image carrier, which is a drum-shaped (cylindrical) electrophotographic photosensitive body (photosensitive body). The photosensitive drum 12 is rotationally driven by a driving force being transmitted from a driving unit (not illustrated) provided in the main body of the image forming apparatus. In the image forming unit, each of the following units are disposed around the photosensitive drum 12 in order in the rotation direction thereof. First, a charging roller 13 which is a rotatable roller-shaped charging member serving as a charging unit is disposed. Next, an exposure device (laser scanner device) 22 serving as an exposure unit (electrostatic latent image forming unit) that exposes the surface of the photosensitive drum 12 is disposed. Next, a developing device 20 serving as a developing unit is arranged. Toner is supplied to the developing device 20 from a toner bottle 21 serving as a toner container via a toner conveyance path (not illustrated). Next, a roller-shaped primary transfer roller 31 as a primary transfer unit is arranged. Next, a drum cleaning device 14 serving as a cleaning unit for the photosensitive body is disposed. Further, in the image forming unit, a roller-shaped cleaning roller 15 (see FIG. 3) serving as a cleaning unit for the charging member is disposed in contact with the charging roller 13. In the present embodiment, the charging roller 13 is brought in contact with the surface of the photosensitive drum 12 at a predetermined pressing force by an urging unit such as a spring, for example, and rotates following the rotation of the photosensitive drum 12.

Further, in the present embodiment, the cleaning roller 15 is brought in contact with the surface of the charging roller 13 at a predetermined pressing force by an urging unit such as a spring, for example, and rotates following the rotation of the charging roller 13.

Also, the image forming apparatus 1 has an intermediate transfer belt 30 formed of an endless belt body and serving as an intermediate transfer body so as to be in contact with the photosensitive drum 12 of each image forming unit. The intermediate transfer belt 30 is wound with a predetermined tension around a plurality of support rollers (tension rollers). The above-described primary transfer rollers 31 are disposed at positions facing each photosensitive drum 12, on the inner circumferential surface side (back surface side) of the intermediate transfer belt 30. The primary transfer roller 31 is pressed against the photosensitive drum 12 over the intermediate transfer belt 30, and forms a primary transfer portion (primary transfer nip portion) where the intermediate transfer belt 30 and the photosensitive drum 12 are in contact with each other. The primary transfer roller 31 rotates following the rotation of the intermediate transfer belt 30.

Further, a roller-shaped secondary transfer roller 33 serving as a secondary transfer unit is disposed at a position facing a secondary transfer opposing roller 32, on the outer circumferential surface side (front surface side) of the intermediate transfer belt 30. The secondary transfer roller 33 is pressed against the secondary transfer opposing roller 32 over the intermediate transfer belt 30, and forms a secondary transfer portion (secondary transfer nip portion) where the intermediate transfer belt 30 and the secondary transfer roller 33 are in contact with each other. Further, a belt cleaning device 40 as an intermediate transfer body cleaning unit is disposed at a position facing a tension roller 35 on the outer circumferential surface side of the intermediate transfer belt 30. The intermediate transfer belt 30 is formed of a dielectric resin such as polyimide in an endless shape.

In addition, the image forming apparatus 1 is provided with feeding/conveyance roller 51 of a printing material P such as a printing sheet, a fixing device 70 for fixing a toner image to the printing material P, and the like.

At the time of image formation, the surface of the photosensitive drum 12 to be rotationally driven is uniformly charged to a predetermined potential of a predetermined polarity by the charging roller 13. In the present embodiment, a voltage is applied to the charging roller 13 from a high-voltage power supply (charging power supply) (not illustrated) to cause discharge of electricity to the surface of the photosensitive drum 12, thereby charging the surface of the photosensitive drum 12.

After the surface of the photosensitive drum 12 is uniformly charged, the surface of the photosensitive drum 12 is scanned and exposed by a laser scanner 22 based on a signal of image information, and an electrostatic latent image (electrostatic image) is formed on the photosensitive drum 12. The latent image formed on the photosensitive drum 12 is developed as a toner image using toner as a developing agent by the developing device 20. In the present embodiment, the normal charging polarity of the toner is negative. The developing device 20 has a developing sleeve as a developing agent carrier that carries and conveys the toner to a portion (developing position) facing the photosensitive drum 12. The developing sleeve is driven to be rotatable. During development, a predetermined developing voltage (developing bias) is applied to the developing sleeve from a high-voltage power supply serving as a developing power supply (not illustrated).

The toner image formed on the photosensitive drum 12 is transferred (primary transferred) onto the surface of the intermediate transfer belt 30 by a function of the primary transfer roller 31 in the primary transfer portion. At this time, a primary transfer voltage (primary transfer bias), which is a voltage opposite in polarity (positive polarity in the present embodiment) to the charging polarity of the toner at the time of development, is applied to the primary transfer roller 31 from a primary transfer power supply (high voltage power supply) (not illustrated). At the time of full-color image formation, the above-described operation is performed in each image forming unit, and the toner images of the respective colors Y (yellow), M (magenta), C (cyan), and K (black) formed on the respective photosensitive drums 12 are transferred onto the intermediate transfer belt 30 so as to be sequentially overlaid. After the transfer, a small amount of untransferred toner remaining on the photosensitive drum 12 is removed by a cleaning blade 14 serving as a cleaning member, and is collected in a collecting portion.

On the other hand, the printing material P is fed one by one from a sheet feeding cassette 50 and conveyed to a registration roller pair 60. Thereafter, the registration roller pair 60 conveys the printing material P between the intermediate transfer belt 30 and the secondary transfer roller 33 in synchronization with the toner image on the intermediate transfer belt 30. The colored toner image on the intermediate transfer belt 30 is transferred (secondary transferred) onto the surface of the printing material P by a function of the secondary transfer roller 33 in the secondary transfer portion. When the printing material P passes through the secondary transfer section, a secondary transfer voltage (secondary transfer bias), which is a voltage opposite in polarity to the charging polarity of the toner at the time of development, is applied to the secondary transfer roller 33 from a secondary transfer power supply (high voltage power supply) (not illustrated). After the transfer, a small amount of residual toner remaining on the intermediate transfer belt 30 is removed and collected by the cleaning unit 40, and preparation is made for the next image formation again. The toner image transferred onto the printing material P is fixed by being heated and pressed by the fixing device 70, and is discharged onto a sheet discharge tray 90 by a discharge roller pair 80.

(Charging Roller)

Figure 2:
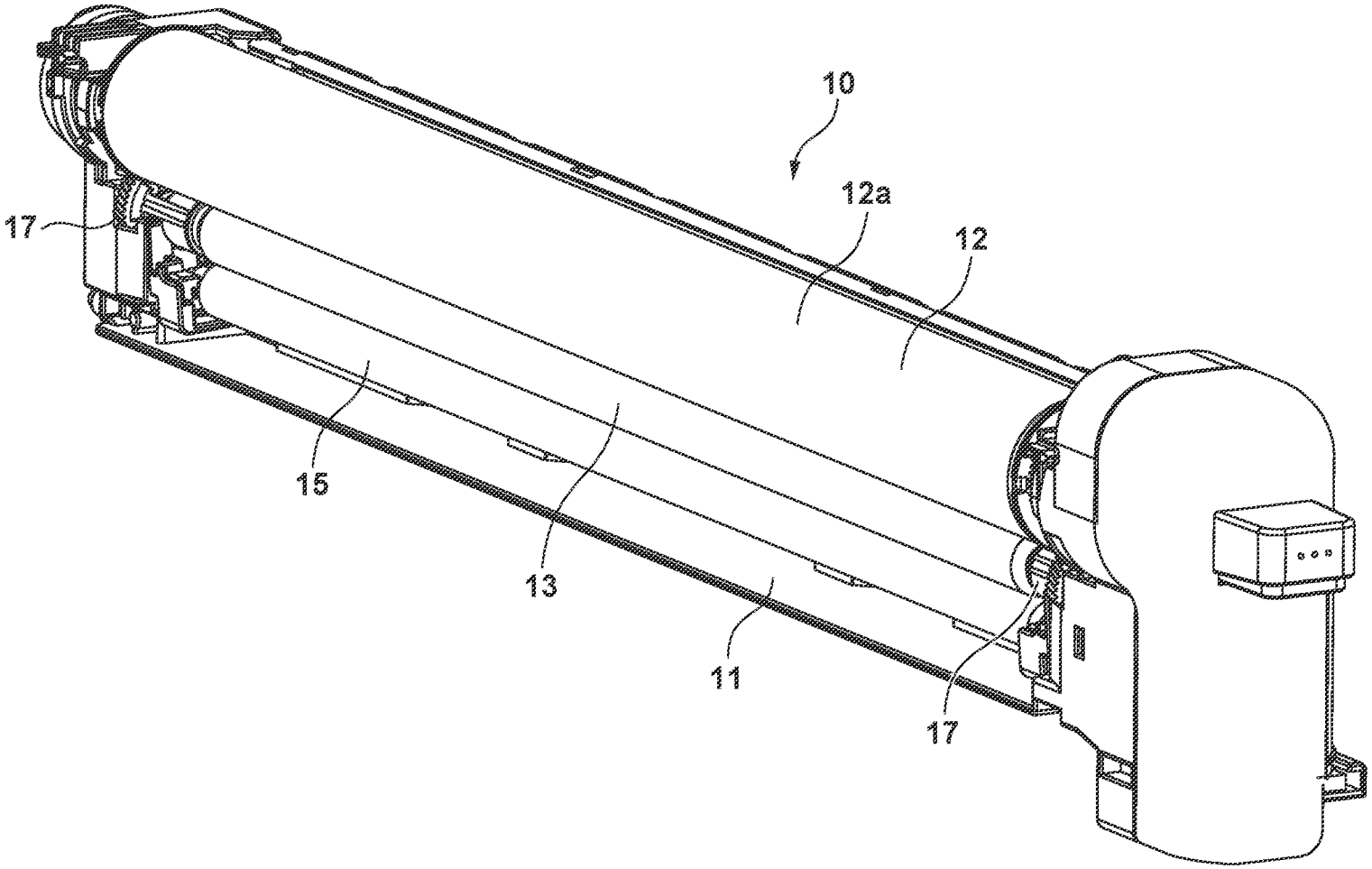
FIG. 2 is a perspective view illustrating a photosensitive unit.

Next, the charging roller 13 according to the present embodiment will be described with reference to FIG. 2 and FIG. 4B.

In the present embodiment, the charging roller 13 serving as a charging member is a roller-shaped member having a conductive support member (a core bar, a core member) 13*a* serving as a rotation shaft and one or more elastic layers 13*b* formed around the conductive support member 13*a*. The outer circumferential surface thereof contacts the photosensitive drum 12 serving as a photosensitive body.

(Cleaning Roller)

Next, the cleaning roller 15 according to the present embodiment will be described with reference to FIG. 2 and FIG. 4B. In the present embodiment, the cleaning roller 15 serving as a member for cleaning the charging member has a rod-shaped support portion (a core bar, a core member) 15*a* serving as a rotation shaft and an elastic layer 15*b* formed around the support portion 15*a*, and the outer circumferential surface thereof is a roller-shaped member that is in contact with the charging roller 13.

(Drum Cartridges)

Next, a configuration of a drum cartridge 10 as a photosensitive unit will be described with reference to FIGS. 2 to 5.

The drum cartridge 10 of the present embodiment is configured by integrally holding the photosensitive drum 12 serving as a photosensitive body, the charging roller 13 serving as a charging member, the cleaning roller 15 serving as a member for cleaning the charging member, and the cleaning blade 14 serving as a cleaning member in a drum container 11 serving as a frame. Further, it is configured to be capable of attaching/detaching to/from the main body of the image forming apparatus by sliding in the longitudinal direction from the main body of the image forming apparatus, and can be replaced for maintenance or the like.

In the drum container 11, the photosensitive drum 12 is held to rotatable about a rotation axis via a bearing (not illustrated). The photosensitive drum 12 is provided with a coupling 122 for receiving a driving force from a motor serving as a driving source (not illustrated) provided in the main body of the image forming apparatus in a state in which the photosensitive drum 12 is mounted to the main body of the image forming apparatus, and rotating (see FIG. 4A).

Figure 3:
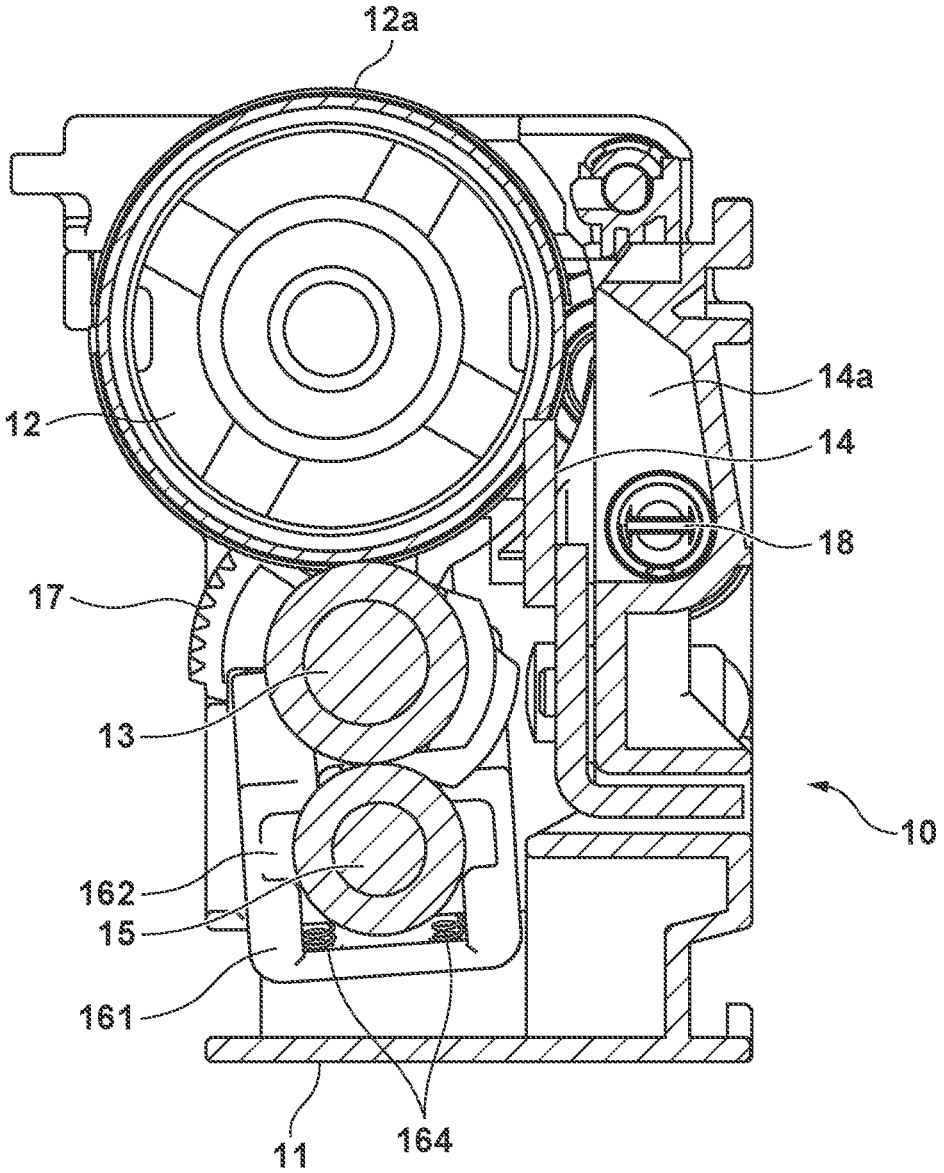
FIG. 3 is a cross-sectional view of the photosensitive unit.

Further, in the drum container 11, the cleaning blade 14 serving as a cleaning member for cleaning the surface of a photosensitive body 12*a* is provided so as to be in contact with the surface of the photosensitive body 12*a* in a direction that is opposite to the rotation direction of the photosensitive drum 12 at the time of image formation, and is fixed (see FIG. 3). Further, a collecting portion 14*a* for collecting the untransferred toner removed from the surface of the photosensitive body by the cleaning blade 14 is provided in the vicinity of the cleaning blade 14. Then, a toner conveyance screw 18 as a conveyance unit for conveying the toner collected in the collecting portion 14*a* to the outside of the drum cartridge 10 (the photosensitive unit) is further provided. Toner transported to the outside of the drum cartridge 10 by the toner conveyance screw 18 is collected in a collected toner container (not illustrated) provided in the main body of the image forming apparatus.

A gear 121 serving as a rotation member fixed so as to rotate together with the photosensitive drum 12 about the rotation axis of the photosensitive drum 12 is provided at a longitudinal end of the photosensitive drum 12. Then, the toner conveyance screw 18 rotates by the rotational force of the gear 121, which rotates together with when the photosensitive drum 12 rotates, being transmitted to the toner conveyance screw 18, and thereby the untransferred toner collected in the collecting portion 14*a* is conveyed to the outside of the drum cartridge 10.

The charging roller 13 is supported to be rotatable by a rotation shaft 13*a* being held in a charging roller bearing 161 serving as a holding portion. Further, the charging roller bearing 161 is supported to be slidable with respect to the drum container 11. Specifically, the charging roller bearing 161 is configured to be slidable in a direction toward the axis of the photosensitive drum 12 so that the supported charging roller 13 can move in a direction toward the rotation axis of the photosensitive drum 12 in a plane perpendicular to the rotation axis of the photosensitive drum 12. Further, a charging roller pressurization spring 163 serving as a first urging unit is provided between the drum container 11 and the charging roller bearing 161. Since the charging roller pressurization spring 163 is urging the charging roller 13 in a direction (urging direction) toward the rotation axis of the photosensitive drum 12, the charging roller 13 is pressed against and in contact with the photosensitive drum 12.

The cleaning roller 15 serving as a member for cleaning the charging member is supported to be rotatable by a rotation shaft 15*a* thereof being supported by a cleaning roller bearing 162, and the cleaning roller bearing 162 is supported to be slidable with respect to the charging roller bearing 161. Specifically, the cleaning roller bearing 162 is configured to be slidable so that the cleaning roller 15 can move in a direction toward the rotation axis of the charging roller 13 in a plane perpendicular to the rotation axis of the charging roller 13. Further, a cleaning roller pressurization spring 164 serving as a second urging unit is provided between the charging roller bearing 161 and the cleaning roller bearing 162. Since the cleaning roller pressurization spring 164 is urging the cleaning roller 15 in a direction toward the rotation axis of the charging roller 13, the cleaning roller 15 is pressed against and in contact with the charging roller 13. In other words, the cleaning roller 15 is disposed to be movable in the urging direction of the cleaning roller pressurization spring 164. Note that in the present embodiment, the urging direction of the charging roller pressurization spring 163 as the first urging unit and the urging direction of the cleaning roller pressurization spring 164 as the second urging unit are the same direction, but even if they are different directions, the effect of the present proposal is not affected.

According to the above configuration, when the photosensitive drum 12 rotates by receiving a driving force from the driving source provided in the main body of the image forming apparatus, the charging roller 13 rotates driven by friction against the photosensitive drum 12. Further, when the charging roller 13 rotates, the cleaning roller 15 rotates driven by friction against the charging roller 13. Further, the toner conveyance screw 18 is rotated by receiving a driving force (rotational force) from the gear 121.

(Spacing Mechanism)

A spacing mechanism that maintains a condition in which the photosensitive drum 12 and the charging roller 13 are spaced apart will be described with reference to FIGS. 4A and 4B.

The drum cartridge 10 serving as a photosensitive unit is provided with spacing members 17 for respectively spacing apart and securing clearance between the charging roller 13 and the photosensitive drum 12 and between the charging roller 13 and the cleaning roller 15 during transportation for distribution.

The spacing members 17 are respectively provided to be rotatable with the rotation shaft 13*a* of the charging roller 13 as the rotation axis at either end of the rotation shaft 13*a* of the charging roller. In other words, the spacing member 17 is supported by the charging roller 13 to be rotatable about the rotation axis of the charging roller 13. Therefore, the spacing member 17 is movable in conjunction with the movement of the charging roller 13. Note that since the configurations of both ends of the charging roller 13 are the same, the present embodiment will be described with reference to a diagram illustrating only one side.

The spacing member 17 is provided with a first spacing portion 174 for spacing the photosensitive drum 12 and the charging roller 13 apart and ensuring clearance. The spacing member 17 is provided with a second spacing portion (spacing portion) 175 for further spacing the charging roller 13 and the cleaning roller 15 apart and ensuring clearance.

In a spaced state (spaced state) which is a state in which the photosensitive drum 12 and the charging roller 13 and the charging roller 13 and the cleaning roller 15 are respectively spaced apart from each other, the first spacing portion 174 is sandwiched between the rotation shaft 13*a* of the charging roller 13 and the gear 121 by the pressurization force (urging force) of the charging roller pressurization spring 163. In the spaced state, the second spacing portion 175 is pressed against the cleaning roller 15 by the pressurization force (urging force) of the cleaning roller pressurization spring 164 and is sandwiched between the rotation shaft 13*a* of the charging roller 13 and the rotation shaft 15*a* of the cleaning roller 15.

Thus, when the drum cartridge 10 is transported, for example, the elastic layer 13*b* of the charging roller 13 and the photosensitive drum 12 are spaced apart from each other, and further, the charging roller 13 and the cleaning roller 15 are spaced apart from each other to ensure clearance.

Figure 4A:
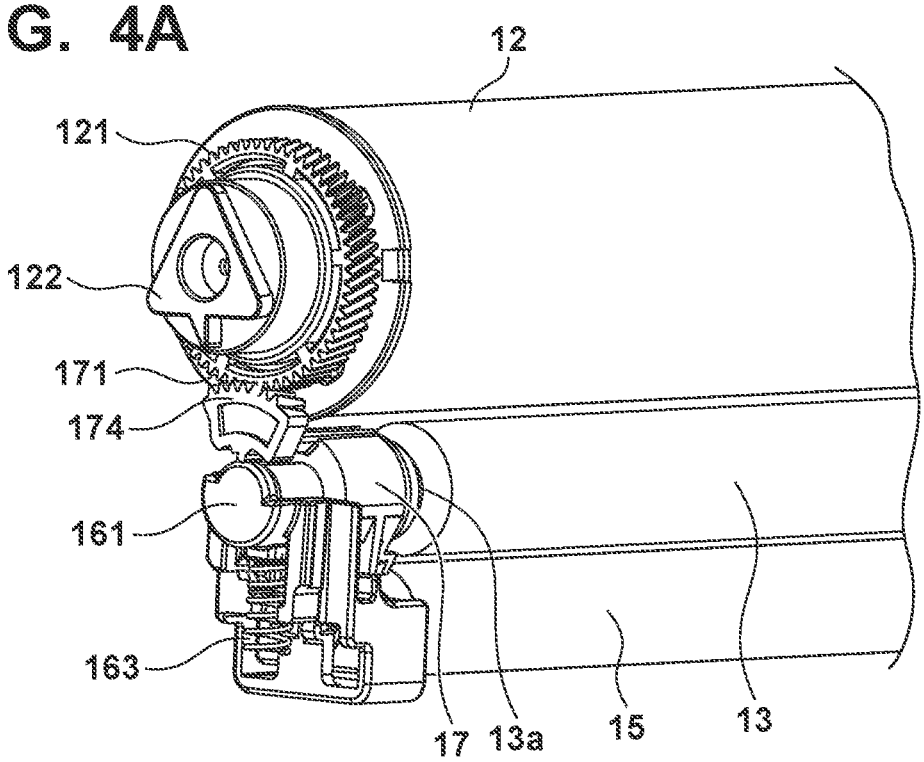
FIGS. 4A and 4B are perspective views of the vicinity of a spacing member in a spaced state.

Further, as illustrated in FIG. 4A, on the surface that faces the gear 121 of the first spacing portion 174 in a spaced state, a first engaging portion 171 having gear teeth of the same pitch as the gear tooth surface pitch of the gear 121 is provided. When in a spaced state in which the photosensitive drum 12 and the charging roller 13 are spaced apart, the first engaging portion 171 is engaged with the gear 121. In other words, at this time, the spacing member 17 is positioned at a spaced position at which a state in which the photosensitive drum 12 and the charging roller 13 are spaced apart is held in a state in which the first engaging portion 171 is engaged with the gear 121. With such a configuration, the spacing member 17 can hold the spaced state.

(Automatically Releasing Spacing)

Figure 5:
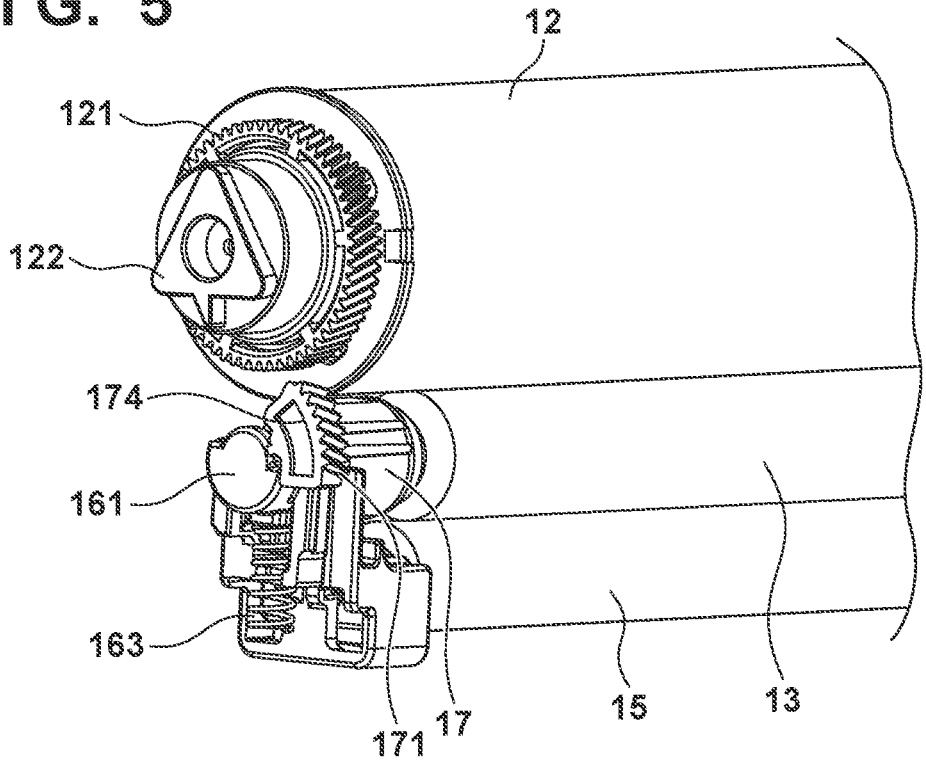
FIG. 5 is a perspective view of the vicinity of the spacing member in a spacing released state.

Next, an automatic release of the spaced state will be described with reference to FIGS. 2 and 5.

When a new drum cartridge 10 is mounted to the main body of the image forming apparatus and the image forming apparatus is started, a driving force (rotational force) is inputted to the photosensitive drum 12 from a motor provided in the main body of the image forming apparatus by an initial operation performed by the main body of the image forming apparatus.

Figure 4B:
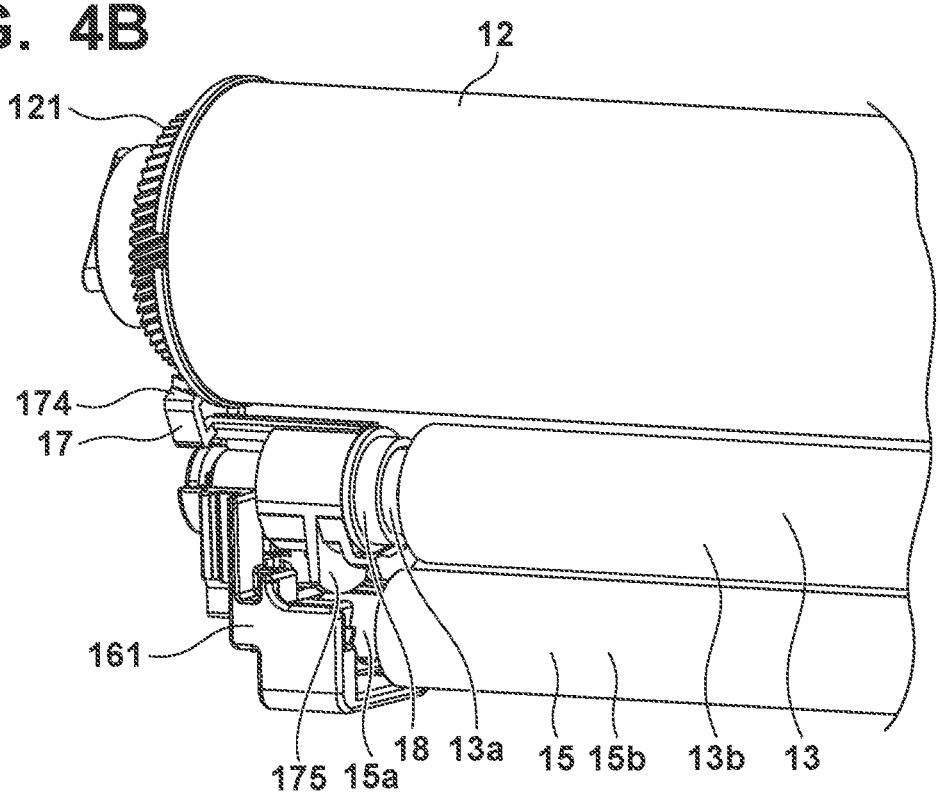

When the rotation of the photosensitive drum 12 is started from a spaced state illustrated in FIGS. 4A and 4B in which the photosensitive drum 12 and the charging roller 13 and the charging roller 13 and the cleaning roller 15 are spaced apart, the gear 121 rotates together with the rotation of the photosensitive drum 12. Then, the first engaging portion 171 of the spacing member 17 engaged with the gear 121 is rotated by receiving the rotational force of the gear 121. By the spacing member 17 being rotated, the first spacing portion 174 is released from a state of being sandwiched between the rotation shaft 13*a* of the charging roller 13 and the gear 121 (space released position). Also, the second spacing portion 175 is released from a state of being sandwiched between the rotation shaft 13*a* of the charging roller 13 and the rotation shaft 15*a* of the cleaning roller 15. Then, the spacing released state illustrated in FIG. 5 is entered. By the above, the automatic release by the spacing member 17 is completed.

(Spacing Configuration of Conventional Configuration)

Figure 6:
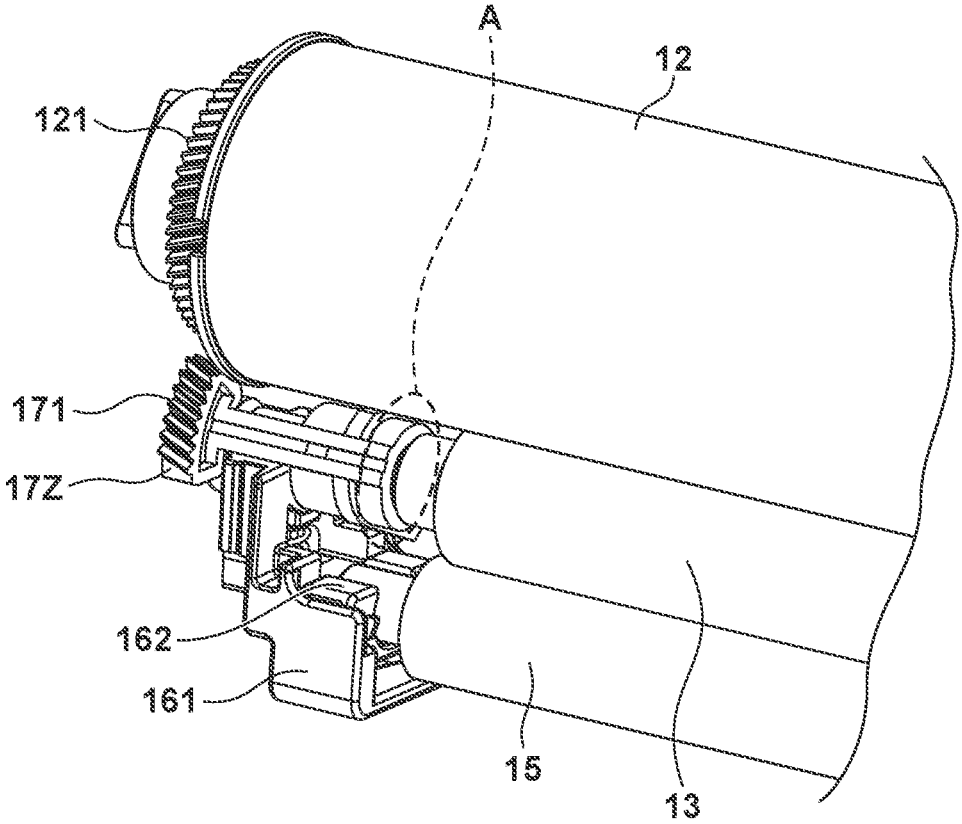
FIG. 6 is a perspective view of the vicinity of a spacing member of a conventional technique.
Figure 7:
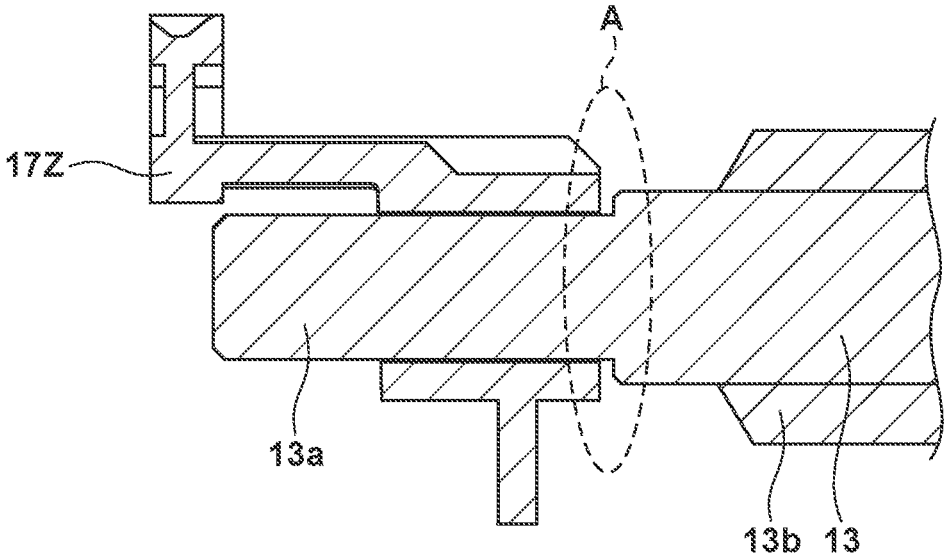
FIG. 7 is a cross-sectional view of the vicinity of the spacing member of the conventional technique.

A description will be given for a spacing member of a conventional configuration with reference to FIG. 6 and FIG. 7. A conventional spacing member 17Z is fitted and held to be rotatable on the rotation shaft 13*a* of the charging roller 13. In such a configuration, since a fitting portion between the spacing member 17Z and the rotation shaft 13*a* of the charging roller 13 is exposed, there is a possibility that an unwanted substance, such as splattered toner, may enter from a portion indicated by A in FIGS. 6 and 7. In a condition in which the spaced state is released, since the rotation shaft 13*a* of the charging roller 13 is relatively rotated with respect to the spacing member 17Z, a frictional force is generated between the spacing member 17Z and the rotation shaft 13*a* of the charging roller 13. When the above-described splattered toner enters this sliding portion, a problem such as abnormal wear of the sliding portion occurs, and there is a possibility that the load torque for rotating the charging roller 13 may increase. If the rotational load torque of the charging roller 13 exceeds the frictional force between the photosensitive drum 12 and the charging roller 13, the charging roller 13 cannot rotate following the photosensitive drum 12, and image defect may occur.

(Spacing Mechanism of First Embodiment)

Figure 8:
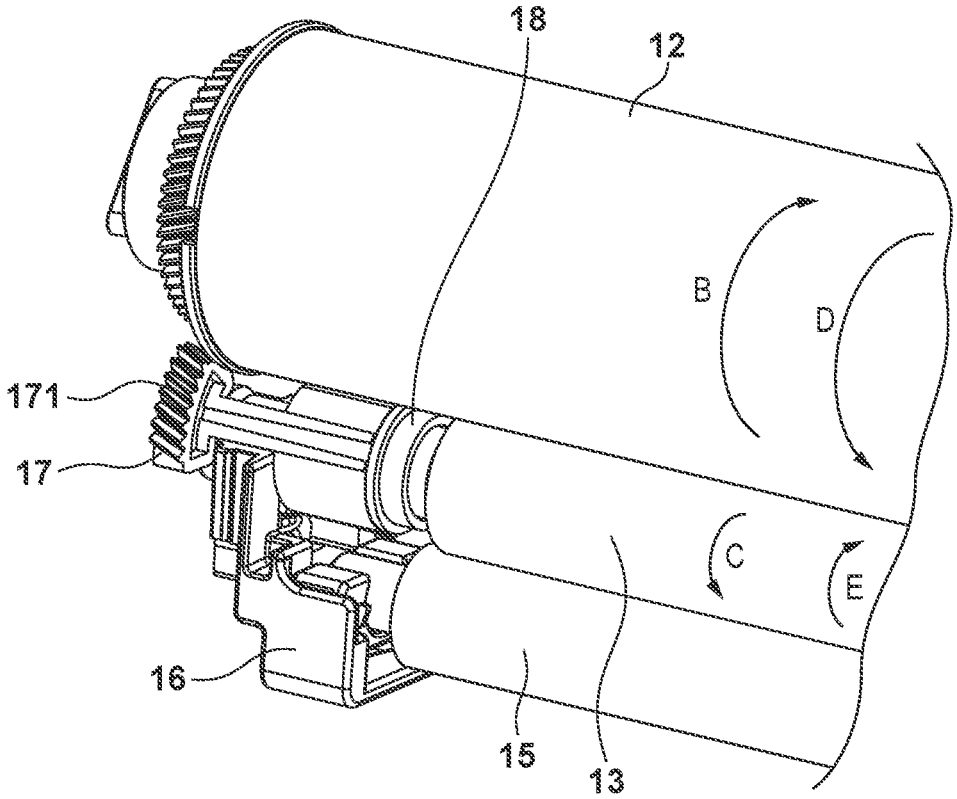
FIG. 8 is a perspective view of the vicinity of a spacing member of a first embodiment.
Figure 9:
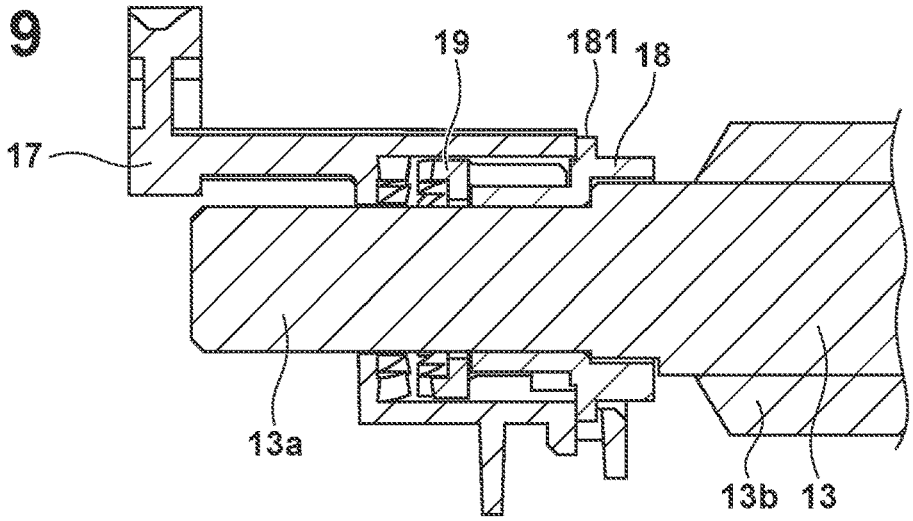
FIG. 9 is a cross-sectional view of the vicinity of the spacing member of the first embodiment.

The spacing mechanism of the first embodiment will be described in more detail with reference to FIGS. 8 to 13B. FIG. 8 is a diagram illustrating a state in which the spaced state is released, and FIG. 9 is a cross-sectional view through the rotation shaft 13*a* of the charging roller 13. The spaced state and the space release operation from the spaced state are omitted because they overlap with the above description.

The spacing mechanism is configured by three parts, the spacing member 17, a lid member 18, and a clutch 19. The spacing member 17 is held to be rotatable on the rotation shaft 13*a* of the charging roller 13. The lid member 18 is held on the rotation shaft 13*a* of the charging roller 13 so as to rotate together with the charging roller 13.

In the present embodiment, the rotation shaft 13*a* of the charging roller 13 is provided in a D-cut shape and is configured to rotate together with the lid member 18. Further, the lid member 18 has a flange portion 181. The flange portion 181 is provided so as to face the end face of the spacing member 17. The clutch 19 is accommodated between the spacing member 17 and the lid member 18 in the axial direction on the rotation shaft of the charging roller 13. The clutch 19 is held to be rotatable on the rotation shaft 13*a* of the charging roller 13, and is provided to be movable on the rotation shaft 13*a* of the charging roller in the rotation axis direction in a cylindrical portion for accommodating the clutch 19 of the spacing member 17. The flange portion 181 of the lid member 18 is supported on the rotation shaft 13*a* of the charging roller 13 so as to cover the cylindrical portion of the spacing member 17 in which the clutch 19 is accommodated.

The spacing mechanism consisting of three parts, the spacing member 17, the lid member 18, and the clutch 19, is configured such that the spacing member 17 and the charging roller spin when the charging roller 13 performs forward rotation. Further, when the charging roller 13 performs reverse rotation, the charging roller 13 and the spacing member 17 rotate together. The mechanism will be explained with reference to FIGS. 10A to 13B.

The diagrams of FIGS. 10A, 11A, 12A and 13A illustrate the charging roller 13, the lid member 18, and the clutch 19, and for convenience of explanation, the spacing member 17 is not illustrated. Further, the diagrams of FIGS. 10B, 11B, 12B, and 13B illustrate the spacing member 17 and the clutch 19, and are cross-sectional views through the rotation shaft of the charging roller 13. Incidentally, in the diagrams of FIGS. 10B, 11B, 12B and 13B, the engagement portion formed by an engaging surface 191 and an inclined surface 192 shows a state in which the other side of the rotational center axis of the spacing member 17 is visible. Therefore, the direction of the inclined surface is drawn reversed with respect to the engaging surface 191 and the inclined surface 192 in the view illustrated in FIGS. 10A, 11A, 12A and 13A.

Figure 10A:
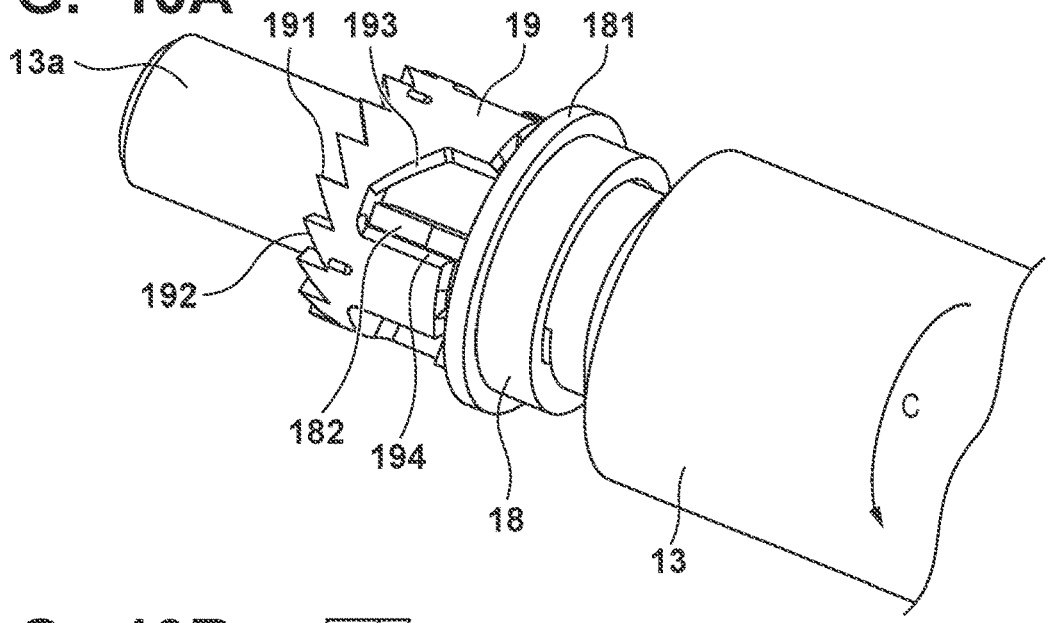
FIGS. 10A and 10B are explanatory views of a clutch operation at a time of a forward rotation of a charging roller.
Figure 10B:
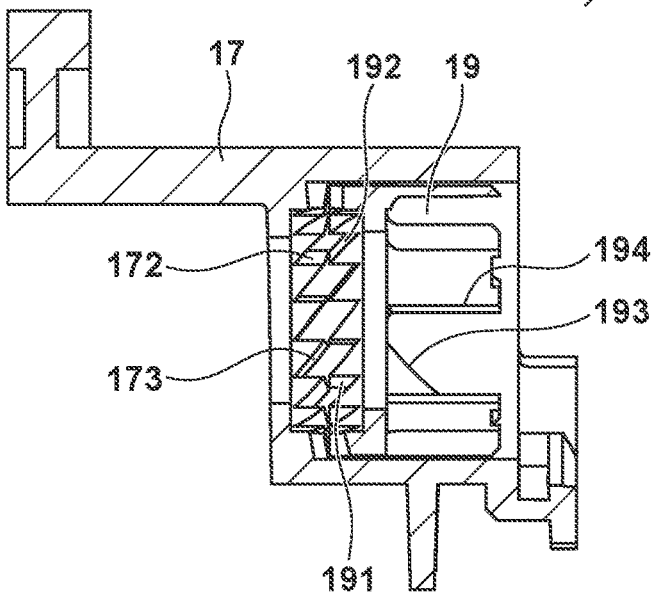

FIGS. 10A and 10B are diagrams illustrating a normal state in which the charging roller performs forward rotation. When the photosensitive drum rotates in a forward direction indicated by an arrow B in FIG. 8, the charging roller 13 rotates in a direction indicated by an arrow C due to driven rotation by a frictional force between the photosensitive drum 12 and the charging roller 13. At this time, since the lid member 18 is supported so as to rotate together with the charging roller 13 on the rotation shaft 13*a* of the charging roller 13, it rotates in the direction of arrow C.

The lid member 18 is provided with a contact surface 182 in contact with the clutch 19, and the clutch 19 is provided with a pressure target surface 194. By the lid member 18 rotating in the direction of arrow C, the contact surface 182 of the lid member 18 presses the pressure target surface 194 of the clutch 19, and the clutch 19 also rotates in the direction of arrow C. The end surface of the clutch 19 opposite from the lid member 18 is provided with the engaging surface 191 and the inclined surface (guide surface) 192, and similarly the spacing member 17 is provided with an engaging surface 172 and an inclined surface (guide surface) 173. The second engaging portion is formed by the engaging surface and the inclined surface of these two parts. As illustrated in FIG. 10B, the engaging surface 191 of the clutch 19 and the engaging surface 172 of the spacing member 17 are in a state in which they do not engage because the position is misaligned in a lengthwise direction of the charging roller 13. Therefore, when the charging roller 13 is rotating forward in the direction of arrow C, the clutch 19 and the spacing member 17 spin, and the rotation of the charging roller 13 is not transmitted to the spacing member 17.

Figure 11A:
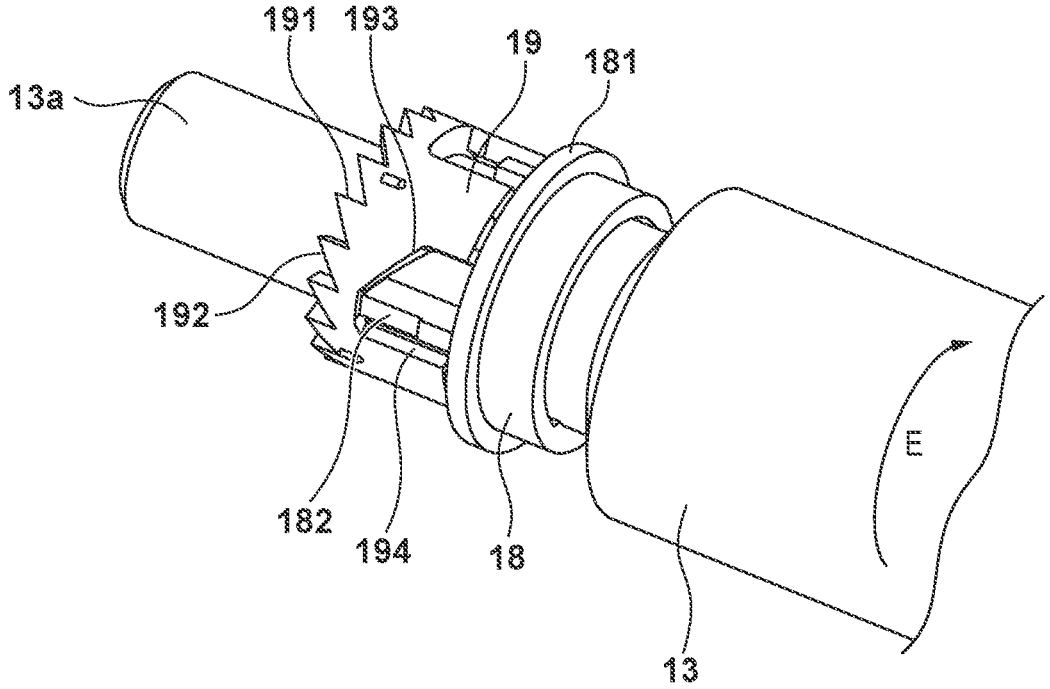
FIGS. 11A and 11B are explanatory views of a clutch operation at a time of a backward rotation of the charging roller.
Figure 11B:
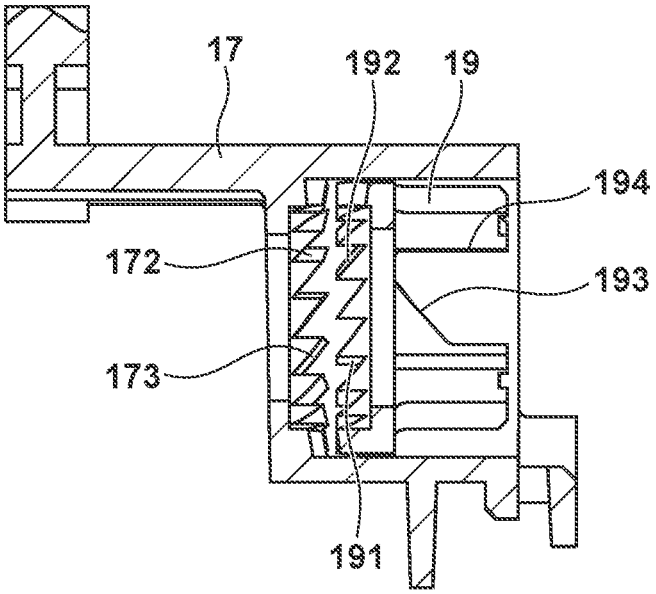

Next, an operation of the charging roller 13 at the time of reverse rotation will be described with reference to FIGS. 11A, 11B, 12A, and 12B. FIGS. 11A and 11B are diagrams illustrating a state in which the charging roller 13 rotates in the direction (reverse rotation direction) of an arrow E from a forward rotation state (a rotation state in the direction of an arrow C). When the photosensitive drum 12 rotates in a direction indicated by an arrow D in FIG. 8, the charging roller 13 rotates in a direction indicated by an arrow E due to driven rotation by a frictional force between the photosensitive drum 12 and the charging roller 13.

Figure 12A:
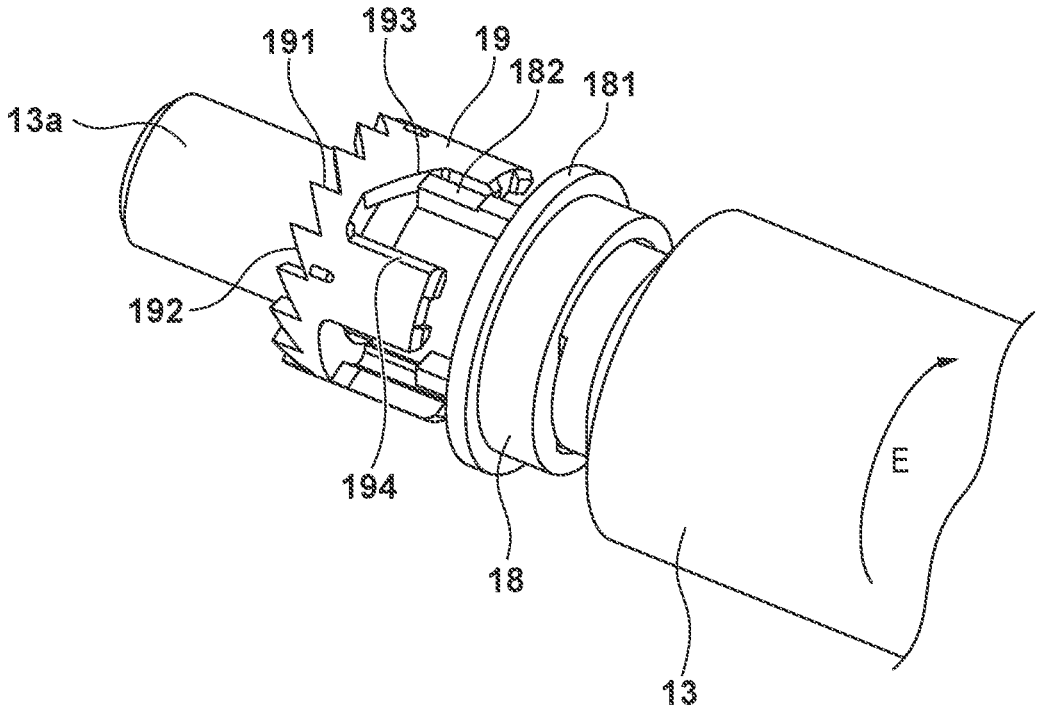
FIGS. 12A and 12B are explanatory views of the clutch operation at a time of the backward rotation of the charging roller.
Figure 12B:
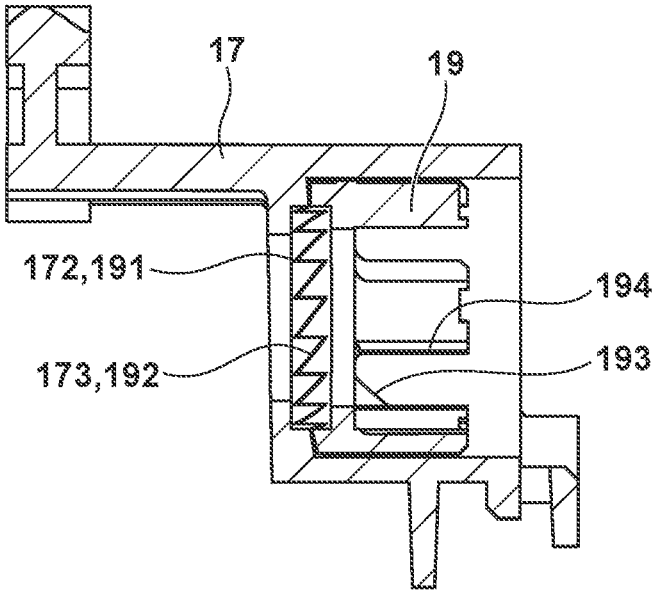

At this time, since the lid member 18 is rotated in the direction of arrow E together with the charging roller 13, the pressing surface 182 of the lid member 18 as illustrated in FIG. 11A is spaced apart from the pressure target surface 194 of the clutch 19 and comes in contact with a pressure target inclined surface (guide surface) 193. Immediately after the pressing surface 182 and the pressure target inclined surface 193 come in contact with each other, the position in the lengthwise direction of the clutch 19 as illustrated in FIG. 11B becomes substantially the same as the position at the time of forward rotation of the charging roller 13 illustrated in FIG. 11B. When the charging roller 13 is further rotated in the direction of arrow E, the pressing surface 182 of the lid member 18 is rotated in the direction of arrow E while in contact with the pressure target inclined surface 193 of the clutch 19. Consequently, by the reaction force received by the pressure target inclined surface 193 from the pressing surface 182, the clutch 19 moves toward the axial end direction of the charging roller 13 on the rotation shaft 13*a* of the charging roller 13 as illustrated in FIG. 12A. Then, the clutch 19 and the second engaging portion of the spacing member 17 enter a state of being engaged as illustrated in FIG. 12B. When the clutch 19 rotates in the direction of the arrow E in this state, by the engaging surface 191 of the clutch 19 and the engaging surface 172 of the spacing member 17 engaging, the spacing member 17 also rotates in the direction of the arrow E.

By this operation, when the charging roller 13 rotates in the direction of the arrow E, the spacing member 17 also rotates together with the charging roller 13 in the direction of the arrow E. When the spacing member 17 rotates a certain amount in the direction of arrow E, the first engaging portion 171 of the spacing member 17 comes in contact with the gear 121. When the first engaging portion 171 of the spacing member 17 is engaged with the gear 121, the first engaging portion 171 receives a rotational force from the gear 121 which rotates together with the photosensitive drum 12 and rotates in the direction of arrow E. Then, the photosensitive drum 12 and the charging roller 13 are spaced apart and enter a spaced state.

When the photosensitive drum 12 is rotated in the direction of the arrow B in FIG. 8 again from the spaced state, the spacing member 17 is rotated in the direction of the arrow C by the spacing release operation described above and a spacing released state is entered. When the spacing released state is entered, the charging roller 13 rotates in the direction of the arrow C by the driven rotation of the photosensitive drum 12 and the charging roller 13 due to frictional force.

Figure 13A:
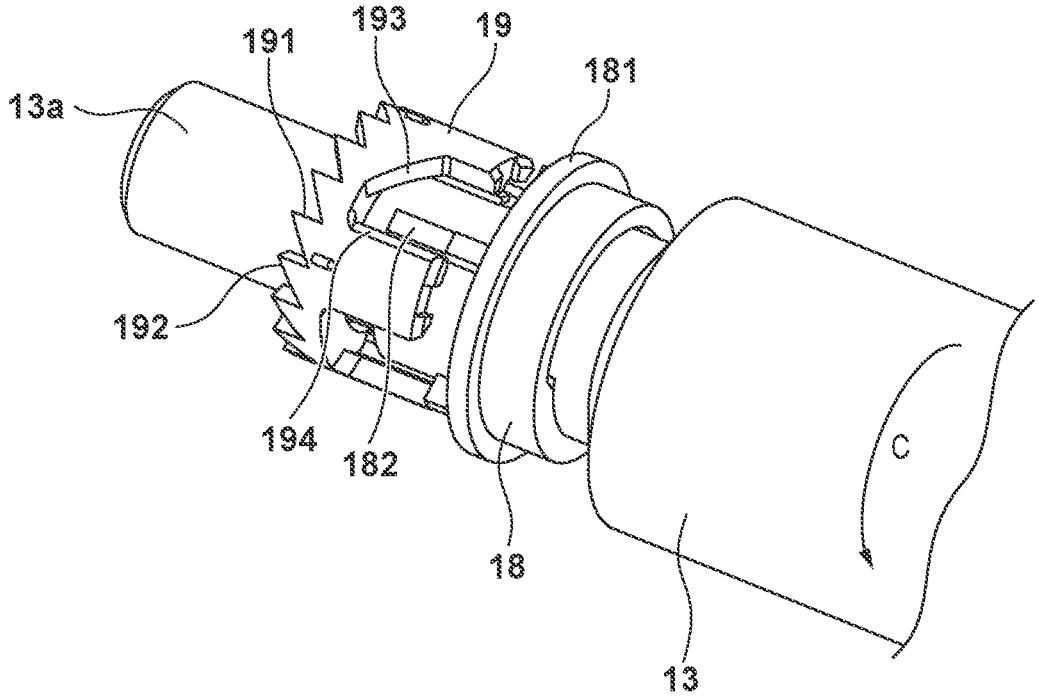
FIGS. 13A and 13B are explanatory views of the clutch operation at a time of the forward rotation of the charging roller.
Figure 13B:
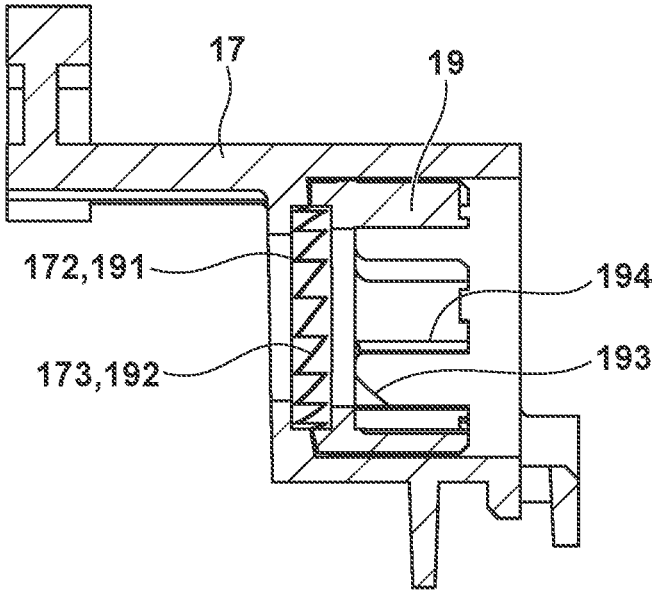

When the charging roller 13 is rotated in the direction of arrow C, the lid member 18 is also rotated in the direction of arrow C together with the charging roller 13, and the pressing surface 182 of the lid member 18 is spaced apart from the pressure target inclined surface 193 of the clutch 19 and comes in contact with the pressure target surface 194 as illustrated in FIG. 13A. At this time, as illustrated in FIG. 13B, the clutch 19 and the second engaging portion of the spacing member 17 are in an engaged state, but when the charging roller 13 further rotates in the direction of the arrow C, the clutch 19 moves in a direction in which the engagement of the second engaging portion is eliminated, that is, in the direction of the lid member 18, by a function of the inclined surface 192 of the clutch 19 and the inclined surface 173 of the spacing member 17. As a result, the engagement of the clutch 19 and the spacing member 17 is eliminated, the rotation of the charging roller 13 in the direction of the arrow C is not transmitted to the spacing member 17, and the charging roller 13 and the spacing member 17 spin.

There is a concern that if the charging roller 13 continues to contact the photosensitive drum 12 at the same location for a long time, a deformation of the charging roller 13 may occur, and thereby, image defect may occur. However, with the above-described configuration, by the photosensitive drum 12 being rotated in a direction (the direction of arrow D) opposite to the rotation direction (the direction of arrow B) of the normal operation not only at the time of shipment of the drum cartridge 10 but at any timing, it becomes possible for the photosensitive drum 12 and the charging roller 13, and the charging roller 13 and the cleaning roller 15 to be in a spaced state, thereby making it possible to prevent deformation of the charging roller 13.

Furthermore, in the configuration of the present embodiment, there is a possibility that the load torque for rotating the charging roller 13 may increase when an unwanted substance, such as the splattered toner, enters the fitting portion between the rotation shaft 13*a* of the charging roller 13 and the spacing member 17, and the fitting portion between the clutch 19, the spacing member 17, and the rotation shaft 13*a* of the charging roller 13. However, in the present embodiment, the fitting portion between the spacing member 17 and the rotation shaft 13*a* of the charging roller 13 and the fitting portion between the clutch 19, the spacing member 17, and the rotation shaft 13*a* of the charging roller 13 are covered by the flange portion 181 of the lid member 18. Therefore, it becomes possible to reduce the amount of invasion of the unwanted substance. Even if an unwanted substance, such as splattered toner, enters the fitting portion between the lid member 18 and the rotation shaft 13*a* of the charging roller 13, since the charging roller 13 and the lid member 18 rotate together, the rotational load torque of the charging roller is not affected.

Second Embodiment (Spacing Mechanism of Second Embodiment)

Figure 14:
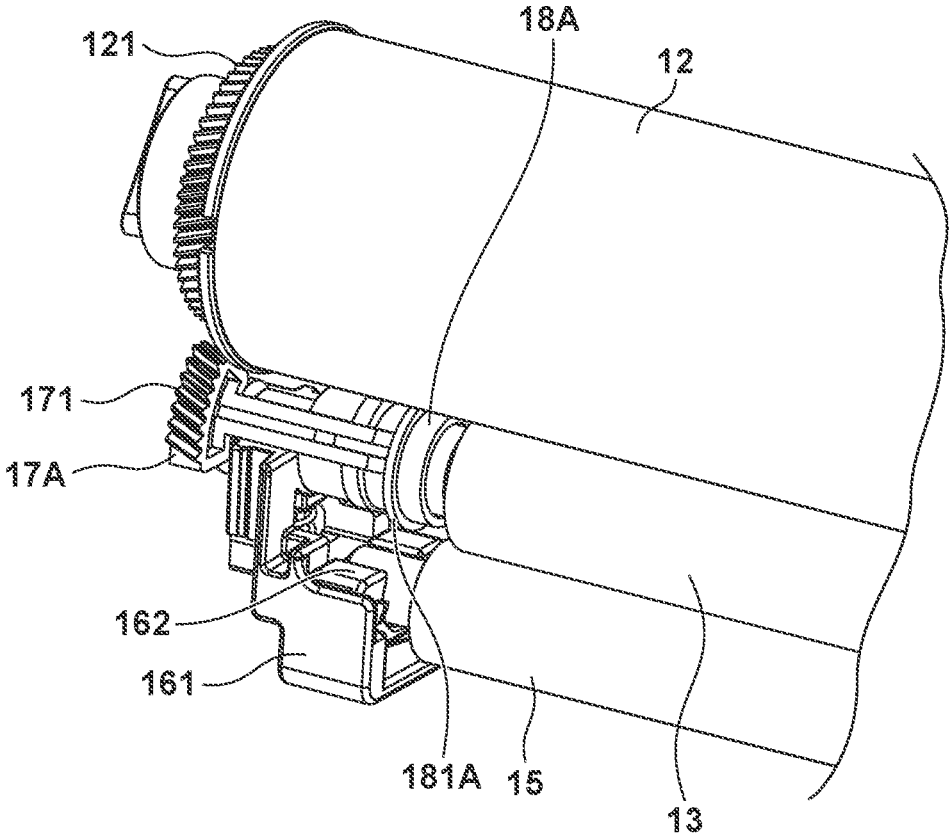
FIG. 14 is a perspective view of the vicinity of a spacing member of a second embodiment.
Figure 15:
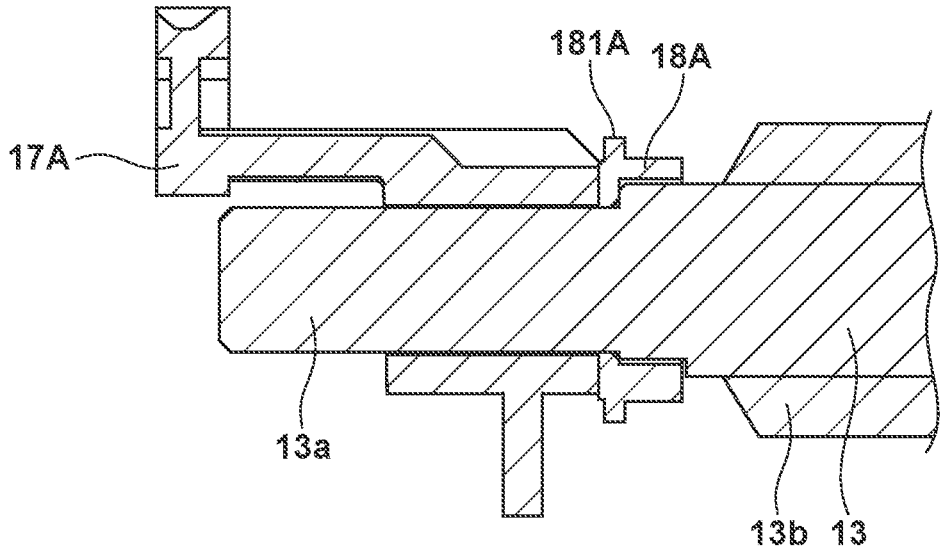
FIG. 15 is a cross-sectional view of the vicinity of the spacing member of the second embodiment.

The second embodiment will be described with reference to FIGS. 14 and 15. FIG. 14 is a diagram illustrating a state in which the spaced state is released, and FIG. 15 is a cross-sectional view through the rotation shaft 13*a* of the charging roller 13. The description of the spaced state and the release operation of the spaced state from the spaced state are omitted because they overlap with the description of the first embodiment.

A spacing member 17A is held to be rotatable on the rotation shaft 13*a* of the charging roller 13. A lid member 18A is held on the rotation shaft 13*a* of the charging roller 13 so as to rotate together with the charging roller 13. In the present embodiment, the rotation shaft 13*a* of the charging roller 13 is provided in a D-cut shape and is configured to rotate together with the lid member 18A. Further, the lid member 18A has a flange portion 181A. The flange portion 181A is provided so as to face the end face of the spacing member 17A. With such a configuration, since the fitting portion between the spacing member 17A and the rotation shaft 13*a* of the charging roller 13 is covered by the flange portion 181A of the lid member 18A, it is possible to prevent an unwanted substance, such as splattered toner, from entering the fitting portion. Even if an unwanted substance, such as splattered toner, enters the fitting portion between the lid member 18A and the rotation shaft 13*a* of the charging roller 13, since the charging roller 13 and the lid member 18A rotate together, the rotational load torque of the charging roller is not affected.

As described above, according to the first and second embodiments, the lid member 18 can prevent an unwanted substance, such as splattered toner, from entering the sliding portion between the spacing member 17 and the charging roller 13. Thus, it becomes possible to provide a configuration for automatically releasing the space between the photosensitive drum 12 and the charging roller 13, which can suppress an increase in the rotational load torque of the charging roller 13. As a result, it becomes possible to reduce the risk of occurrence of a charging roller slip due to an increase in the rotational load torque of the charging roller 13.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-175357, filed Oct. 19, 2020, which is hereby incorporated by reference herein in its entirety.

What is claimed is:

1. An image forming apparatus comprising:

a frame;

a photosensitive drum supported so as to be rotatable with respect to the frame;

a charging roller including an elastic layer, supported by the frame so as to be rotatable, and configured to contact the photosensitive drum and charge the photosensitive drum;

an urging portion configured to urge the charging roller in a direction toward the photosensitive drum;

a driving source configured to rotationally drive the photosensitive drum;

a rotation member configured to rotate using a driving force inputted from the driving source;

a spacing member provided on a rotation shaft of the charging roller and held to be rotatable on the rotation shaft of the charging roller, the spacing member configured to include an engaging portion that engages with the rotation member and receives a driving force from the rotation member, and to be rotatable between a spaced position at which, in a state in which the engaging portion is engaged with the rotation member, a spaced state in which the photosensitive drum and the charging roller are spaced apart is maintained, and a released position at which the spaced state between the photosensitive drum and the charging roller is released and the photosensitive drum and the charging roller are caused to be in contact; and a cover portion provided on the rotation shaft of the charging roller, and configured to cover an end face of the spacing member with respect to a direction of a rotation axis of the charging roller so that a fitting portion of the charging roller and the spacing member is covered, and rotate together with the charging roller.

2. The image forming apparatus according to claim 1, wherein the rotation member rotates together with the photosensitive drum by the driving force inputted from the driving source.

3. The image forming apparatus according to claim 1, further comprising a cleaning roller including an elastic layer, supported by the frame so as to be rotatable, and configured to contact the charging roller and clean the charging roller, wherein the spacing member, in the spaced position of the photosensitive drum and the charging roller, includes a spacing portion that spaces the charging roller and the cleaning roller apart.

4. The image forming apparatus according to claim 3, wherein the cleaning roller is supported to be movable in a direction away from a direction approaching the rotation shaft of the charging roller with respect to the charging roller.

5. The image forming apparatus according to claim 4, wherein the cleaning roller is urged in the direction approaching the charging roller.

6. The image forming apparatus according to claim 1, further comprising a cleaning roller including an elastic layer, supported by the frame so as to be rotatable, and configured to contact the charging roller and clean the charging roller, wherein the spacing member, in the spaced position of the photosensitive drum and the charging roller, includes a spacing portion that spaces the charging roller and the cleaning roller apart.

7. An image forming apparatus comprising:

a frame;

a photosensitive drum supported so as to be rotatable with respect to the frame;

a charging roller including an elastic layer, supported by the frame so as to be rotatable, and configured to contact the photosensitive drum and charge the photosensitive drum;

an urging portion configured to urge the charging roller in a direction toward the photosensitive drum;

a driving source configured to rotationally drive the photosensitive drum;

a rotation member configured to rotate using a driving force inputted from the driving source;

a spacing member provided on a rotation shaft of the charging roller and held to be rotatable on the rotation shaft of the charging roller, the spacing member configured to include an engaging portion that engages with the rotation member and receives a driving force from the rotation member, and to be rotatable between a spaced position at which, in a state in which the engaging portion is engaged with the rotation member, a spaced state in which the photosensitive drum and the charging roller are spaced apart is maintained, and a released position at which the spaced state between the photosensitive drum and the charging roller is released and the photosensitive drum and the charging roller are caused to be in contact;

a cover portion provided on the rotation shaft of the charging roller, and configured to cover an end face of the spacing member with respect to a direction of a rotation axis line of the charging roller so that a fitting portion of the charging roller and the spacing member is covered, and rotate together with the charging roller; and a clutch provided between the spacing member and the cover portion with respect to an axial direction of the rotation shaft of the charging roller, and configured to switch between a state in which rotation of the charging roller is transmitted to the spacing member and a state in which rotation of the charging roller is not transmitted to the spacing member.

8. The image forming apparatus according to claim 7, wherein the rotation member rotates together with the photosensitive drum by the driving force inputted from the driving source.

9. The image forming apparatus according to claim 7, wherein the clutch, in a case where the charging roller rotates in a first direction, does not transmit the rotation of the charging roller to the spacing member, and in a case where the charging roller rotates in a second direction opposite of the first direction, transmits the rotation of the charging roller to the spacing member.

10. The image forming apparatus according to claim 9, wherein at the time of image formation, the charging roller rotates in the first direction.

11. The image forming apparatus according to claim 9, wherein the spacing member and the clutch respectively comprise engaging surfaces that engage with each other in a case where the charging roller rotates in the second direction and inclined surfaces that guide the clutch in a direction in which engagement is released in a case where the charging roller rotates in the first direction.

12. The image forming apparatus according to claim 9, wherein the cover portion includes a contact surface that contacts the clutch, and the clutch includes a pressure target inclined surface that, in a case where the charging roller rotates in the second direction, contacts the contact surface and guides the clutch to a side approaching the spacing member.

13. The image forming apparatus according to claim 7, wherein the cleaning roller is supported to be movable in a direction away from a direction approaching the rotation shaft of the charging roller with respect to the charging roller.

14. The image forming apparatus according to claim 13, wherein the cleaning roller is urged in the direction approaching the charging roller.

* * * * *